US009291012B2

(12) United States Patent
Wells, Sr.

(10) Patent No.: US 9,291,012 B2
(45) Date of Patent: Mar. 22, 2016

(54) PLURAL INPUT MUD-COLLECTING MANIFOLD

(71) Applicant: Fabrication of Rig and Exploration Equipment, Inc., Cleveland, TX (US)

(72) Inventor: David Allen Wells, Sr., Cleveland, TX (US)

(73) Assignee: Fabrication of Rig and Exploration Equipment, Inc., Cleveland, TX (US)

( * ) Notice: Subject to any disclaimer, the term of this patent is extended or adjusted under 35 U.S.C. 154(b) by 72 days.

(21) Appl. No.: 13/960,968

(22) Filed: Aug. 7, 2013

(65) Prior Publication Data

US 2015/0041220 A1 Feb. 12, 2015

(51) Int. Cl.

| | |
|---|---|
| ***E21B 21/01*** | (2006.01) |
| ***E21B 21/10*** | (2006.01) |
| ***E21B 21/06*** | (2006.01) |
| *E21B 21/00* | (2006.01) |

(52) U.S. Cl.

CPC ..... *E21B 21/01* (2013.01); *E21B 21/06* (2013.01); *E21B 21/10* (2013.01); *E21B 2021/007* (2013.01)

(58) Field of Classification Search

CPC ... E21B 2021/007; E21B 21/01; E21B 21/06; E21B 21/08; E21B 21/10; F16L 41/03

See application file for complete search history.

(56) References Cited

U.S. PATENT DOCUMENTS

| | | | | | |
|---|---|---|---|---|---|
| 1,932,106 | A * | 10/1933 | Hirschberg | E21B 7/026 | 173/141 |
| 5,540,292 | A * | 7/1996 | Behrens | E21B 7/02 | 173/184 |
| 5,699,834 | A * | 12/1997 | Hayashi | F15B 13/0817 | 137/271 |
| 2008/0080992 | A1* | 4/2008 | Cummins | F04B 15/02 | 417/404 |
| 2009/0114443 | A1 | 5/2009 | Talamo et al. | | |
| 2011/0304138 | A1* | 12/2011 | Commoner | E21B 43/0122 | 285/368 |
| 2013/0299018 | A1* | 11/2013 | Elliott | F16L 41/03 | 137/561 A |

FOREIGN PATENT DOCUMENTS

WO 93/06335 A1 4/1993

* cited by examiner

*Primary Examiner* — Robert E Fuller
*Assistant Examiner* — Christopher Sebesta
(74) *Attorney, Agent, or Firm* — Robert C. Rolnik

(57) ABSTRACT

A manifold directs the flow of drilling mud from a drilling rig. A longitudinal tubular body has a first end and a second end, such that the longitudinal tubular body is supported by at least two supports of a platform. The platform can support a monorail that is parallel to the longitudinal tubular body, so that it is five feet of the longitudinal tubular body. The longitudinal tubular body can have at least three side directed input ports so that the ports are adapted to receive a mud pipe for attachment. Each of the three side-directed input ports can face substantially towards and above the monorail to provide unobstructed lateral attachment of a mud pipe to the longitudinal tubular body.

18 Claims, 6 Drawing Sheets

PLURAL INPUT MUD-COLLECTING MANIFOLD

BACKGROUND

The present invention relates to a effluent removal system, and more specifically, to a pipe that permits attachment of a drilling rig mud pipe in roughly the proportional steps by which a rig is walked to serial borehole openings.

Operators routinely re-use drilling rigs at substantially the same drill-site in order to place multiple drill-holes. Each drill-hole is the product of a drill-bit that is laterally guided to disparate petrochemical bearing formations. The drilling rigs are serially placed; then used to drill down into the earth; and to complete each borehole so that fluids may be extracted. However, under conventional methods, the crew whom are to perform operations of drilling rock and completing the well, can be left idle during a critical phase of the lateral drilling operations. Namely, the crew is unable to do these operations during the time that the drilling rig is being moved to the borehole site, even though such a site is within a few meters of the previous borehole.

A number of utilities are detached and reattached to the drill rig before and after the rig is moved. Among these utilities is the effluent pipe that takes used mud from the rig and places it into a storage tank. Since the conventional mud pipe is often larger than a foot in diameter, and are structured to handle heavy fluids, the mud pipe can weigh so much as to require a crane and the coordination of pipe-fitters. As such, the operation just to connect and extend the mud pipe to reach the stationary storage tank can impose delays that leave both the rig and the drilling crew idle, while still consuming budget for completing the several wells.

Accordingly, a remedy is sought to the above-stated problem.

SUMMARY

According to one embodiment of the present invention a manifold, in part, directs the flow of drilling mud from a drilling rig. A longitudinal tubular body has a first end and a second end, such that the longitudinal tubular body is supported by at least two supports of a platform. The platform can support a monorail that is parallel to the longitudinal tubular body, so that it is within five feet of the longitudinal tubular body. The longitudinal tubular body can have side directed input ports so that the ports are adapted to receive a mud pipe for attachment. Each of the side-directed input ports can face substantially towards and above the monorail to provide unobstructed lateral attachment of a mud pipe to the longitudinal tubular body.

A further embodiment discloses another manifold for directing flow of drilling mud from a drilling rig. As such, a longitudinal body has a first and second supports, wherein the longitudinal body has at least two parallel sideways extending pipes. The longitudinal body has a downstream end and a upstream end having a flange with through-holes for bolting additional conduits to such downstream and upstream ends. Two monorail supports can extend from the longitudinal body to support a monorail that is substantially parallel a longitudinal axis of the longitudinal body.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

A manifold is semi-permanently connected to a mud storage tank in a manner that permits quick disconnects and reconnects along several input ports along the length of the manifold. Such a manifold, once installed at a drilling site, provides the input ports separated by roughly the distance between drilling rig boreholes. Such input ports allow a mud pipe, aligned normal to the manifold's axis, to be positioned for repetitive attachment to each input port, in series. As such, minimal pipe-fitting is required to break, move and reconnect the drilling rig relative to the manifold. In particular, FIG. 2A-2D show the relative movements of a drilling rig relative to the manifold.

Figure 1:
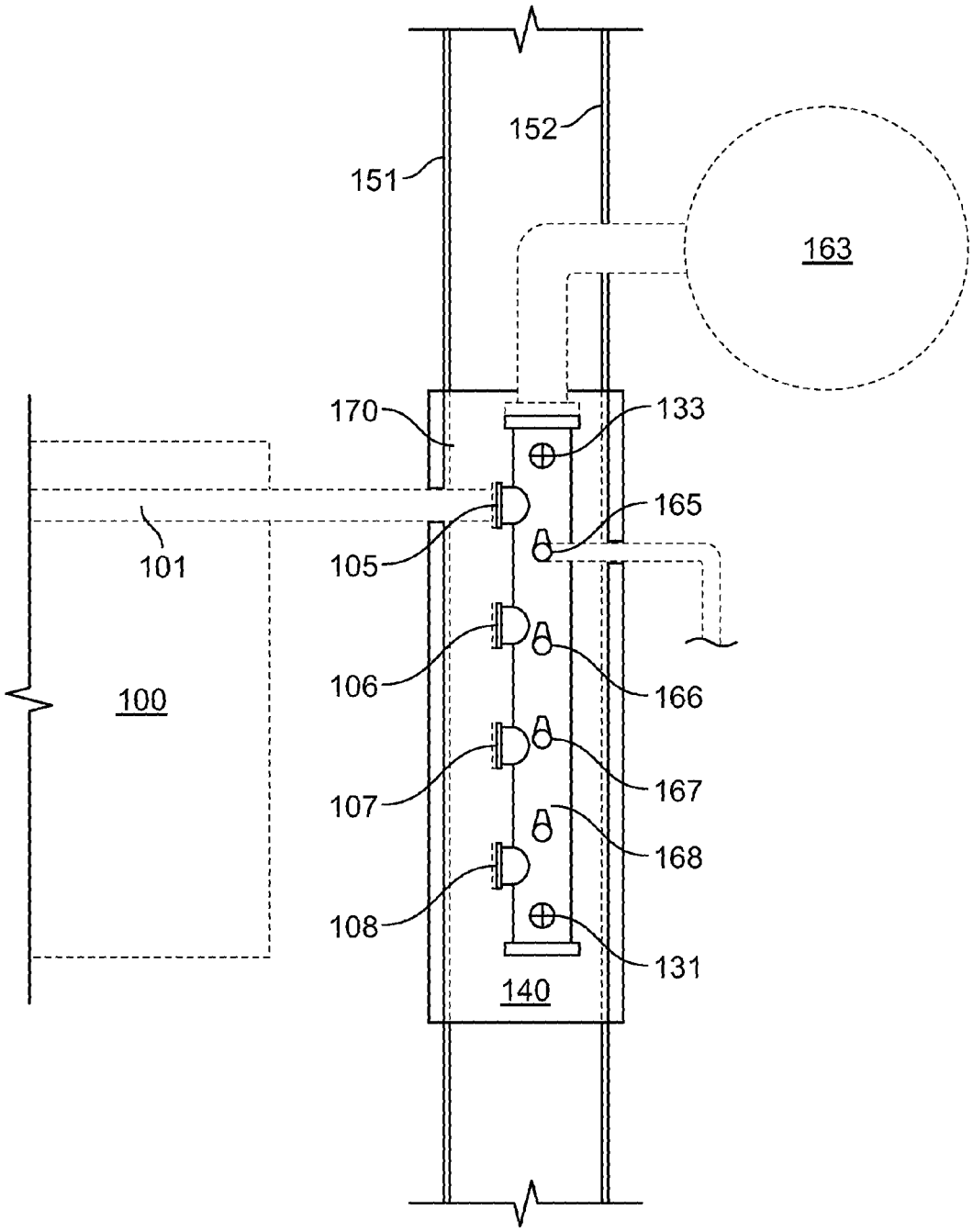
FIG. 1 is a top view of a rig and an embodiment in accordance with an embodiment of the invention.

With reference now to the figures and in particular with reference to FIG. 1 is a top view of a rig and an embodiment in accordance with an embodiment of the invention. A trolley 140, or other platform may be used to support manifold 102 in a position where it can receive mud pipe 101 from rig 100. A rig is a drilling rig or other platform used to support drilling operations. A trolley is any mobile platform that can be moved at least laterally. The trolley does not necessarily rely on wheels to move along a rail. The trolley can rest on skids, or alternatively, tractor treads. The manifold is arranged along a longitudinal tubular body. As such, the platform can be distinct from the longitudinal tube shape of the manifold. However, some embodiments may incorporate the structure of the longitudinal tubular body as the chief structural element, and thus, the longitudinal tubular body, itself, may serve as a platform to additional supports that extend therefrom. In other words, the platform need not be flat nor even planar, though it is pictured as such in the Figures that follow.

Manifold 102 can receive mud pipe 101 at input port 105. An input port is any lateral opening in the longitudinal structure of a manifold. A lateral opening can receive a pipe that is angled downward to promote fluid flow. The lateral opening can include sideways extending pipes that form a 'T-junction' with a longitudinal body of the manifold. The sideways extending pipes can be parallel to each other. Each sideways extending pipe can terminate at a vertical plane that extends in a direction parallel to the longitudinal pipe, but is offset to one side of the longitudinal axis of the manifold. Although described here as 'openings', the terminal ends of such pipes can be openings in spite of being covered with plates that are removable by drilling rig operators. Although, for exemplary purposes, FIG. 1, and other figures show four input ports, embodiments of the invention provide at least two input ports that can each be used to take the mud pipe connection.

Figure 3:
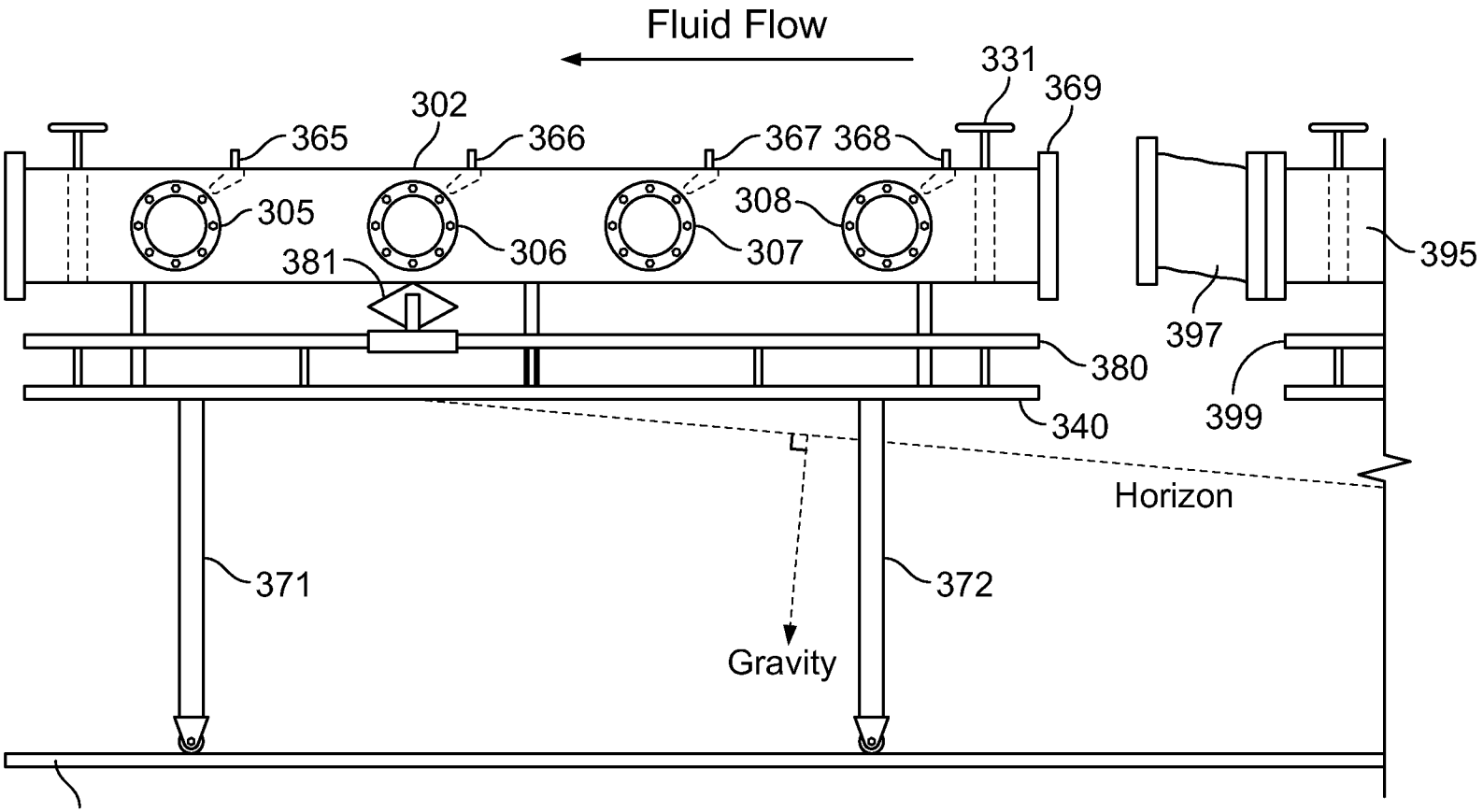
FIG. 3 are side views in accordance with an embodiment of the invention.

FIG. 1 shows the rig at a position that may be used to drill a first hole at the site. During this time, the unused input ports 106, 107 and 108 can be sealed with a plate to cover the openings and prevent mud from flowing out. Similarly, upstream valve 131 can be closed to prevent flow through that end of manifold 102. Manifold 102 may be angled, as seen in FIG. 3, to promote gravity flow of the mud in a forward direction, which is the direction towards connector pipe 160 connecting to storage tank 163. Downstream valve 133 is proximal to the end of manifold 102 that connects via a connector pipe 160 to storage tank 163. It is appreciated that downstream valve 133 is described as downstream because the embodiment is inclined such that downstream valve 133 is below upstream valve 131. Nevertheless, in hilly terrain, the manifold can be oriented so that the relative positions are reversed. In other words, due to the configuration of the drill site, the fluid flow may operate to send fluid out the manifold end nearest to upstream valve 131. Accordingly, the terms upstream and downstream are used for convenience and to correspond to the figures herein. It is appreciated that fluid flow may leave either end of the manifold, depending on the inclination of the manifold at the drill site.

In order to assist with moving mud or dispersing blockages, one or more directional nozzles 165-168 can be used to provide a stream of water or other non-viscous substance in the direction of the desired mud flow. One nozzle is shown for each input port. However it is appreciated that further nozzles can be placed at multiple locations near each input port, thereby each promoting mud movement, as needed.

In order to assist in the placement of the manifold, trolley 140 may be supported by two rails 151 and 152. The rails can extend underneath the length of the platform. Further, atop trolley 140 is monorail 170 that provides support to the distal end of mud pipe 101, particularly during times that the pipe is disconnected from the manifold 102 during installation or movements of rig 100. The distal end of mud pipe 101 is the end that connects, or can be connected, to the manifold. Such an end is distal with respect to rig 100.

Figure 2A:
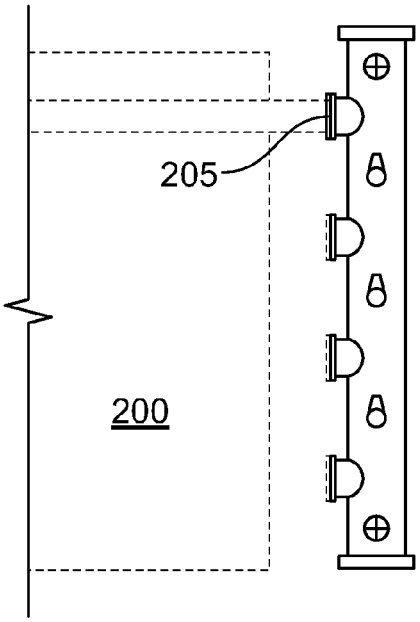
FIGS. 2A-2D show top views the relative movements of a drilling rig relative to the manifold in accordance with an embodiment of the invention.
Figure 2B:
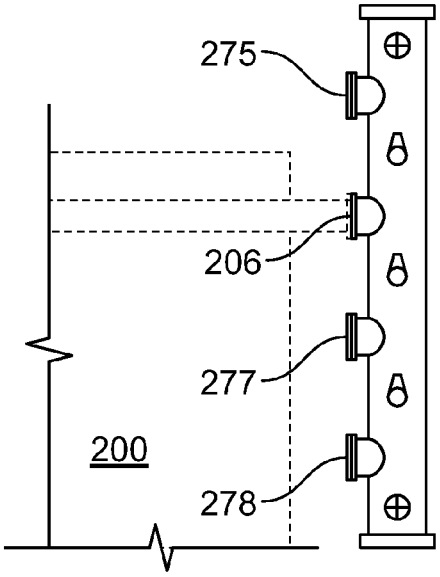
Figure 2C:
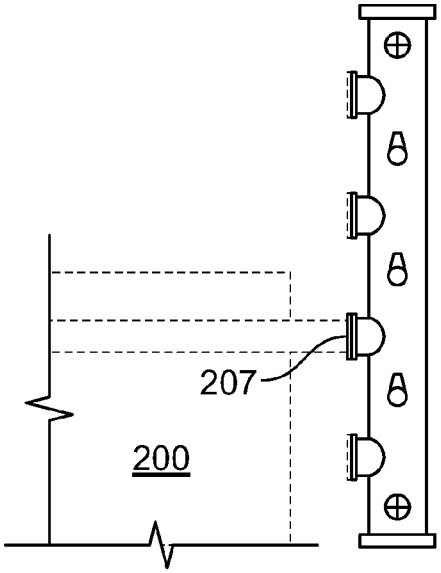
Figure 2D:
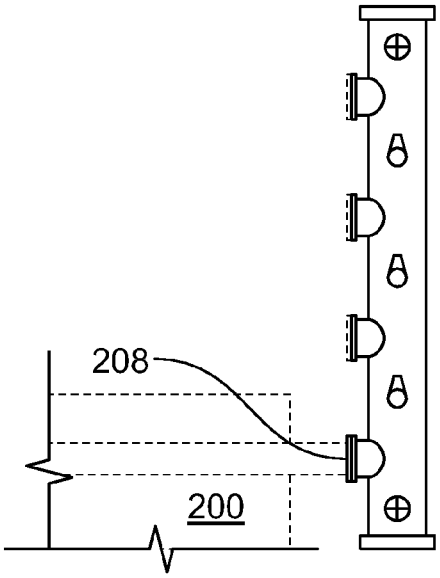

FIG. 2A-2D are top views showing the differing positions the rig may have relative to an embodiment of the invention. FIG. 2A shows the connection of the mud pipe from the rig attaching to the first input port 205. FIG. 2B shows rig 200 moved to a second borehole in a manner that allows connection to second input port 206. FIG. 2C shows the rig moved to a third borehole and connected to third input port 207. FIG. 2D shows the rig attached to the fourth input port 208. An additional slidable jack is used to permit continuous support of the mud pipe's distal end (relative to the rig) on trolley 240 via, for example, monorail 170 of FIG. 1. The slidable jack is more directly shown at FIG. 3, below.

In each of the mud pipe positions at FIG. 2A-2D, each side-directed input ports faces substantially towards and above the monorail to provide unobstructed lateral attachment of a mud pipe. Accordingly, the monorail may undergird the mud pipe. Those input ports that are not connected to the mud pipe are covered by plates, as shown in FIG. 2B as plates 275, 277 and 278. Each such plate is detachable and can be interchanged with the other plates to selectively close each input port. Further attachments, for example, at the downstream end and the upstream ends of each manifold are not shown in order to more clearly see the iterative mobility of the rig relative to each input port. It is appreciated that such plates can be fastened with bolts that attach to flanges along the periphery of the openings of each input port. Alternatively, the plates may attach by a helical screw onto a helical grove etched in the outside of each port. Many other alternative ways of attaching the plate(s) are possible.

FIG. 3 is a side view in accordance with an embodiment of the invention. FIG. 3 shows manifold 302, from the side that typically faces the rig during drilling operations. All but one input ports is covered by a removable plate so that one input port at a time is open to use by a mud pipe. FIG. 3 shows the manifold without the mud pipe attached. Manifold 302 takes its initial support from rail 351 that rests on terrain or a foundation. Wheeled supports 371, 372 may extend from the rails (a second rail is parallel the first rail) to support the horizontal body or platform of trolley 340. Manifold 302 can be angled to direct mud to the left in this figure. Each input port 305, 306, 307 and 308 may have a flange and circumferential bolt holes that permit bolt attachment and detachment of the mud pipe, as seen best at input port 306. As such, drilling operator crews can attach or detach the mud pipe, or alternatively, covering plates, with nuts and bolts. It is appreciated that many alternative ways to close the openings of each input port are available, including screw caps, valves, and the like. Manifold 302 can be raised at one end to promote gravitational flow toward a lowered end and out a downstream opening. Manifold 340 can be raised either by providing a first support that is higher than a second support.

Monorail 380 supports slidable jack 381 which can be used to support the mud pipe. The pipe is thus supported when filled with mud, and also, has a means for support while the rig is walked to its next drill site. In other words, as the rig moves, roughly in parallel to the rails, the slidable jack can move along with the mud pipe to maintain support between each input port. FIG. 3 shows slidable jack 381 in the position corresponding to FIG. 2B where the mud pipe attaches to the second lowest output port. Four nozzles 365, 366, 367 and 368 are upstream of each corresponding input port. Each nozzle can be used provide a feeder hose or other supply (not shown) is connected to it. When a feeder hose supplies a non-viscous liquid, the nozzle can jet mud further towards the storage tank. A single detachable hose is connected to nozzle 366 in order to promote movement of mud through input port 306. The detachable hose can be reattached concurrently with each new input-port that is connected to the mud pipe.

During an initial four operations to drill four successive boreholes, upstream valve 331 can remain closed to prevent mud from exiting that end of the longitudinal tubular body that comprises the bulk of the manifold. Nevertheless, the upstream valve can be opened in tandem with the placement of a second manifold, depicted as second manifold 395, into connection to the raised end of manifold 302.

As an aid to attaching second manifold 395 to manifold 302, a flex hose 397 can be attached to a lower end of second manifold 395. Alternate embodiments may provide flex hose on manifold 302 at its raised end 369. It is appreciated, that trolleys and manifolds that are built with narrow tolerances may require no flex hose, and thus can be simply bolted one end to another. In each embodiment, the second manifold is generally raised higher than the first manifold, and placed at a near identical angle in order to permit attachment without significant leaks.

Second manifold 395 can be placed upon a second trolley that may rely on the same rail 351 to linearly align the two or more manifolds. Further, second monorail 399, is at the same level or otherwise in substantial alignment to the first monorail 380 when the trolleys and corresponding manifolds are attached to their corresponding modular units. As such, the slidable jack can be supported in movements across trolleys.

Figure 4:
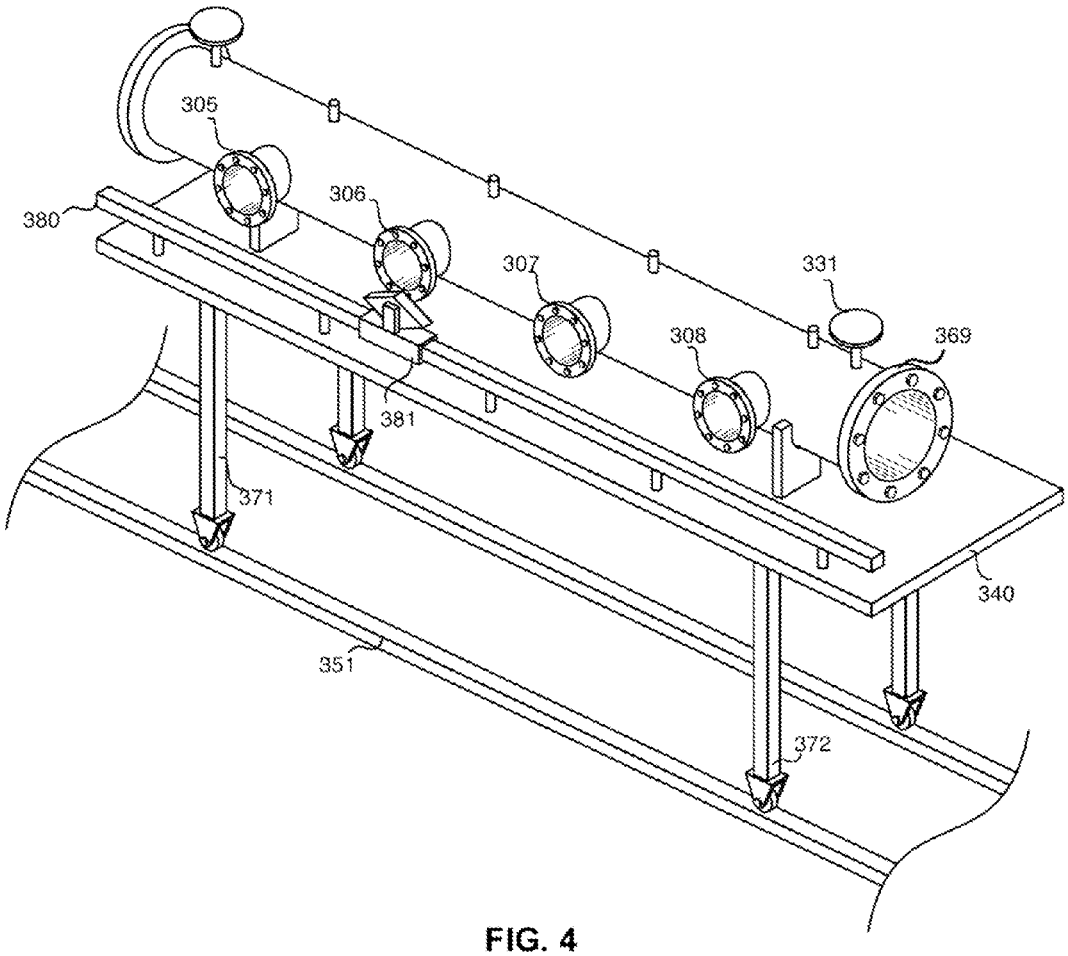
FIG. 4 is an isometric view in accordance with an embodiment of the invention.

FIG. 4 is an isometric view in accordance with an embodiment of the invention. It is noted that railings and ladders are omitted from the figures to permit more direct viewing of the main structural elements of the manifold. However, in many embodiments, such ladders and railings can assist workers in conducting the attachments and detachments to the manifold, as described further, below.

Figure 5:
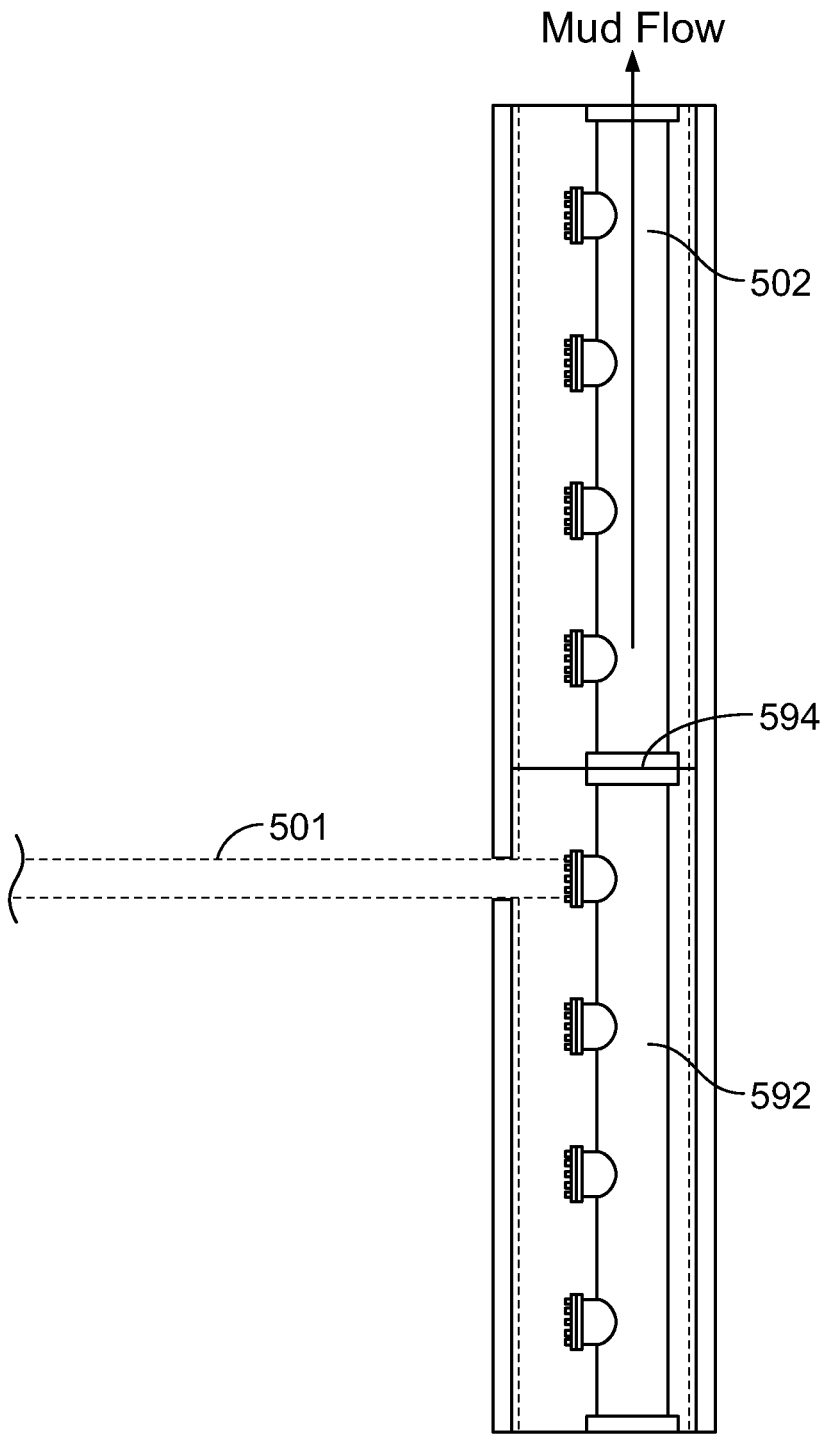
FIG. 5 is a view of two embodiments attached in succession in accordance with embodiments of the invention.

FIG. 5 is a view of two embodiments attached in succession in accordance with embodiments of the invention. The two manifolds, manifold 502 and manifold 592 are shown without a connecting flex-hose. It is appreciated that such an arrangement can be possible if the tolerances of the alignment are sufficiently close to prevent leaks from the junction 594 between each manifold. As can be seen, the input ports provided by two manifolds provide co-planar interfaces for mud pipe 501 to connect while the rig is moved among up to eight drilling positions.

Referring to FIG. 3, the manner of moving the mud pipe from a first drill site to a second drill site can include the following steps. First, the mud pipe is substantially emptied and released from an input port, for example, input port 305. A plate covering the next port, for example, input port 306 is removed to open the input port to mud. An operator can have a worker push the slidable jack concurrently with the rig being walked to the next borehole site. This stage, after walking the rig, and corresponding the mud pipe, is visible at FIG. 3, though the drill rig and mud pipe are not shown, for better understanding of the manifold configuration. Correspondingly, the distal end of the mud pipe, that rests atop the jack, moves along with the rig, without impediment in close proximity to the manifold. Slidable jack 381 can ride along monorail and lubricant can be added as needed to keep the jack moving. The rig can stop when the mud pipe aligns to the next input port. As needed, the worker can extend slidable jack 381 to raise the distal end of the mud pipe.

A worker may then bolt the mud pipe to the next input port. The recently vacated input port, in this case, input port 305 can receive a covering plate when a worker installs it. Any feeder hose that supplied a first nozzle can be removed and reattached to a nozzle proximal to the input port 306. Valves 321 and 331 may be omitted in some embodiments. For example, upstream valve 331 can, be substituted with a bolt-on plate to cover opening 369 when such opening is not in use. Similarly, downstream valve 321 may be omitted altogether.

If the final borehole among four holes is completed, additional steps may be taken to modularly add an additional manifold. First, the upstream valve can be opened in the first manifold. In embodiments that rely on a plate to cover the elevated end of the first manifold, the plate can be removed to open that end of the tubular body of the manifold. The trolley supporting the second manifold and monorail is slid along the rails to abut to the first trolley of the lower or first manifold. If alignment is sufficient to bolt the first manifold to the second manifold, then a worker bolts the first manifold to the second manifold along a flange of the pipe or longitudinal tube. However, if alignment is insufficient, a flex-hose can be placed between first manifold and second manifold so that mud may flow from second manifold to the first manifold. It is appreciated that other extending pipes may be placed between each manifold if a longer distance is required between the last completed drill hole and the new hole that the rig is being positioned to drill upon.

The monorail is extended as the first monorail aligns to the second monorail, which is supported on the second trolley. As such, at this point, both a further input port is opened, and a monorail support is placed substantially in front of the input port to assist in moving the mud pipe atop the slidable jack. Continued operations can thus extend to an additional fifth through eight input port on a similarly configured manifold that is united to the initial manifold. Alternatively, an operator may begin with two or more manifolds that initially provide many input-ports, and later, as wells are completed, move the rig closer to the storage tank. Accordingly, the more manifolds, that are remote from the mud tank, can be removed after the last input-port is used.

A number of variations to the manifold have been described. First, adjustable valves can be placed at one or both ends of the manifold. Alternatively, covering plates can be attached to block unwanted flows, as needed. Alternative methods to block the unused input ports can include placing valves proximal to each port, rather than the plates used to cover each unused port, as depicted herein. Further, nozzles can be attached and used routinely, or not at all, depending on the viscosity of the mud.

Figure 6:
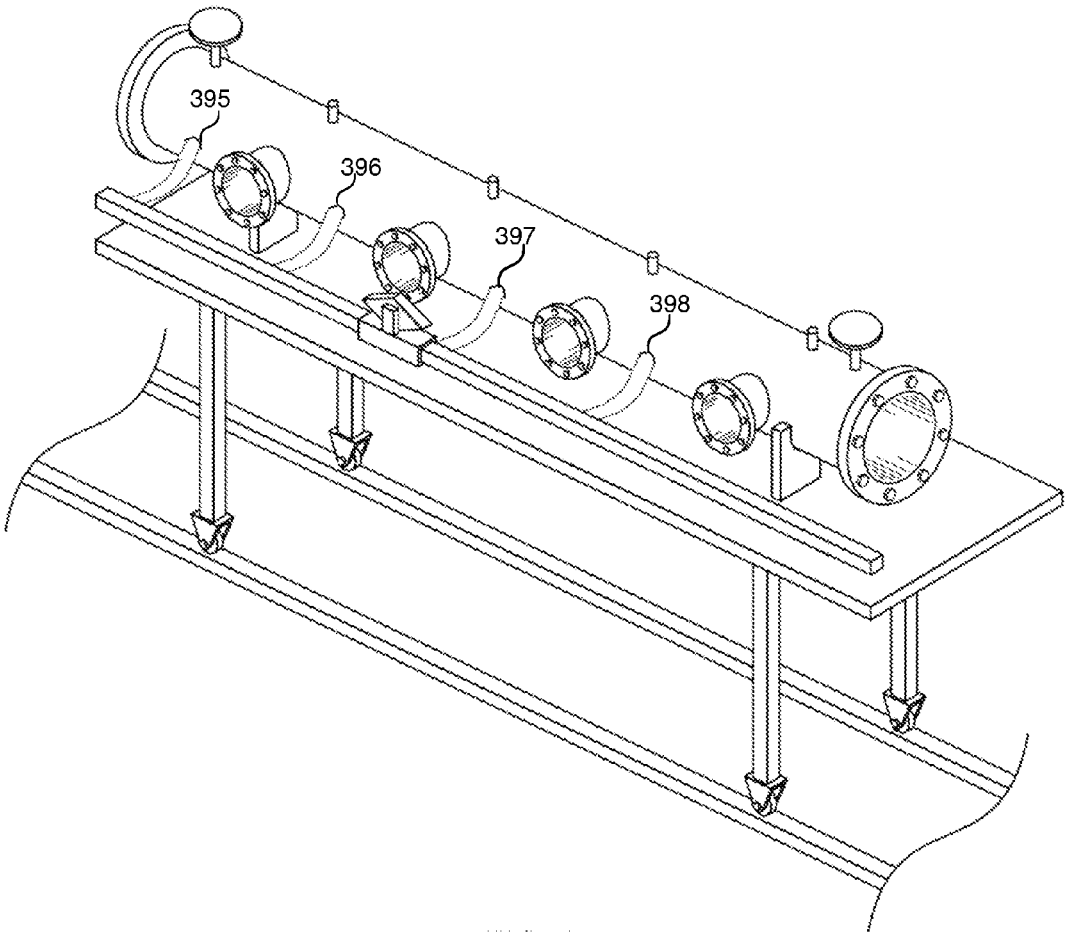
FIG. 6 is an orthogonal view of the monorail supported from the tubular body with supports.

FIG. 6 shows that the longitudinal tubular body of the manifold may itself be a platform. Accordingly, monorail supports 395, 396, 397, 398 can be extended from the exterior of the tubular body to support a monorail substantially parallel to the longitudinal axis of the manifold. Further, the monorail can be positioned below a hypothetical extension of sideways extending pipe of the manifold in order to provide clearance to, and support for, a mud pipe that can engage each such sideways extending pipe. The monorail can be placed within five feet of the end of each sideways extending pipe.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A manifold for directing the flow of drilling mud from a drilling rig, the manifold comprising:

a longitudinal tubular body having a first end and a second end, the longitudinal tubular body is supported by at least two supports of a platform;

a monorail that is parallel to the longitudinal tubular body, the monorail also supported by the platform such that the monorail is within five feet of the longitudinal tubular body and arranged parallel to a longitudinal axis of the longitudinal tubular body; and at least two side-directed input ports in the longitudinal tubular body adapted to receive a mud pipe for attachment, wherein each of the at least two side-directed input ports faces substantially towards and above the monorail to provide unobstructed lateral attachment of a mud pipe.

2. The manifold of claim 1, further comprising nozzles, one corresponding to each of the at least two side-directed input ports, each nozzle directed internal to the longitudinal tubular body and towards the first end.

3. The manifold of claim 1, further comprising a slidable jack placed on top of the monorail, to further support and raise a mud pipe.

4. The manifold of claim 1, wherein the second end is raised above the first end to orient the longitudinal tubular body above 20° of horizontal.

5. The manifold of claim 1 further comprising a valve for opening the second end for flow.

6. The manifold of claim 1, further comprising a flex-hose attached to the first end or the second end.

7. The manifold of claim 1, wherein each input port has a flange having holes for bolting onto a corresponding flange of a mud pipe.

8. The manifold of claim 1, wherein the second end has a flange having holes for bolting onto a corresponding flange of a second manifold.

9. The manifold of claim 1, further comprising a flex-hose extending an end of the longitudinal tubular body, wherein the end is selected from the group consisting of the first end and the second end.

10. A manifold for directing flow of drilling mud from a drilling rig, the manifold comprising:

a longitudinal body having a first support and a second support, wherein the longitudinal body has at least two sideways extending pipes that extend in parallel to each other;

wherein the longitudinal body has a downstream terminal end located at an end-point of the longitudinal body and an upstream terminal end located at an end-point of the longitudinal body opposite to the downstream terminal end, wherein each of the downstream and upstream terminal ends has a flange with through-holes for bolting additional conduits to such downstream and upstream terminal ends;

wherein the longitudinal body has at least two monorail supports extending therefrom to support a monorail, and the monorail is substantially below the at least two sideways extending pipes and the at least two sideways extending pipes support a monorail to be substantially parallel to a longitudinal axis of the longitudinal body.

11. The manifold of claim 10, wherein the monorail is rigidly held within five feet of the sideways extending pipe.

12. The manifold of claim 10, wherein the monorail supports a slidable jack.

13. The manifold of claim 10, further comprising nozzles, one corresponding to each sideways extending pipes, each nozzle directed internal to the longitudinal body and towards a first end of the longitudinal body.

14. The manifold of claim 10, further comprising a slidable jack placed on top of the monorail, to further support and raise a mud pipe.

15. The manifold of claim 10, wherein the upstream terminal end is raised above the downstream terminal end to tilt the longitudinal body above 20° of horizontal.

16. The manifold of claim 15 further comprising a valve for opening the second end for flow.

17. The manifold of claim 10, further comprising a flex-hose attached to a the upstream terminal end or the downstream terminal end of the longitudinal body.

18. The manifold of claim 10, wherein each of the sideways extending pipes has a flange having holes for bolting onto a corresponding flange of a mud pipe.

* * * * *